US007390231B1

(12) United States Patent
Pelini

(10) Patent No.: US 7,390,231 B1
(45) Date of Patent: Jun. 24, 2008

(54) ANTI-SPLASH PAN SYSTEM

(76) Inventor: Mark F. Pelini, 406 Sonoma Dr., Valrico, FL (US) 33594

( * ) Notice: Subject to any disclaimer, the term of this patent is extended or adjusted under 35 U.S.C. 154(b) by 0 days.

(21) Appl. No.: 11/787,385

(22) Filed: Apr. 16, 2007

(51) Int. Cl.
*B63H 5/125* (2006.01)

(52) U.S. Cl. ..... 440/61 E

(58) Field of Classification Search ..... 440/61 E
See application file for complete search history.

(56) References Cited

U.S. PATENT DOCUMENTS 4,227,480 A 10/1980 Carras
4,559,889 A 12/1985 Olson
4,713,028 A * 12/1987 Duff ..... 440/61 R
5,052,320 A 10/1991 Cremer
5,782,662 A 7/1998 Icenogle
5,997,370 A 12/1999 Fetchko
6,132,271 A * 10/2000 Hebert ..... 440/59

* cited by examiner

*Primary Examiner*—Stephen Avila
(74) *Attorney, Agent, or Firm*—Edward P. Dutkiewicz

(57) ABSTRACT

A pan has a large central section in a rectangular configuration. The pan has parallel front and rear edges and parallel side edges. The side edges have upturned sections. The side edges have a plurality of apertures. The apertures couple the pan to side plates of a jack plate/hydraulic cylinder housing. The sides of the central section are in proximity to side plates adjacent to lower edges of side plates of a housing. The rear of the pan is in proximity to slots of a housing. The front of the pan is in proximity to front plates of a housing. In this manner the pan will abate the splashing of water onto a hydraulic cylinder during operation and use.

6 Claims, 2 Drawing Sheets

FIG 1
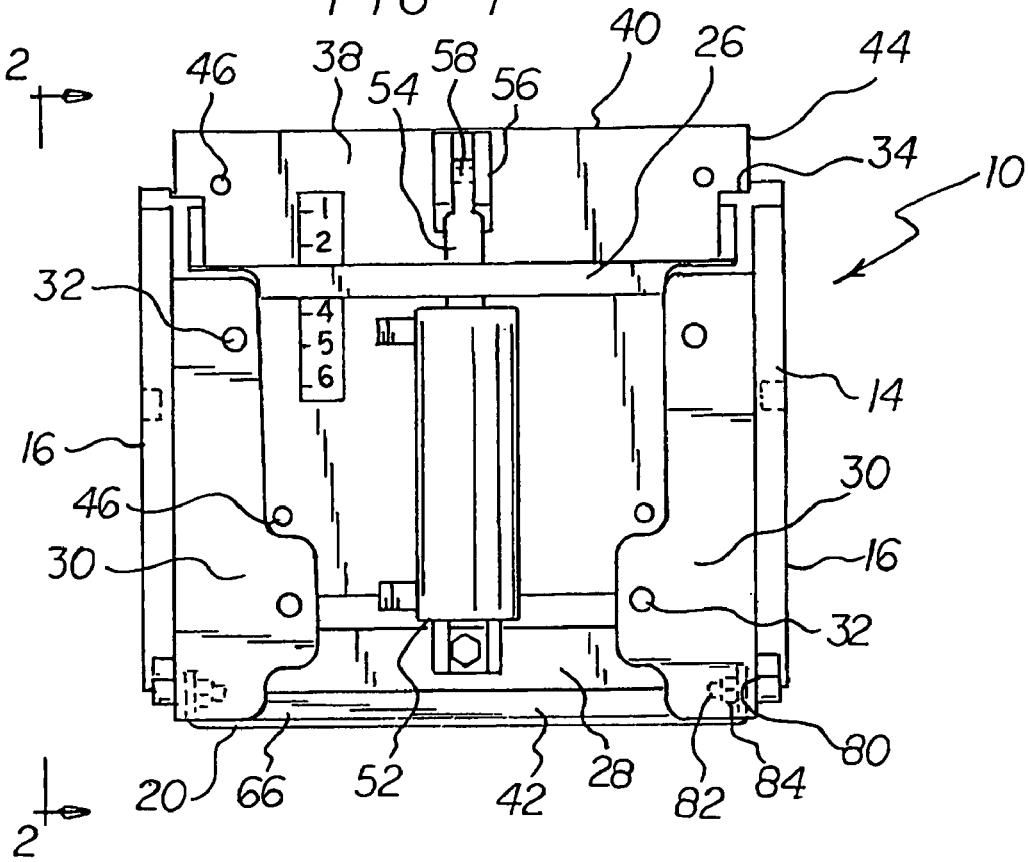
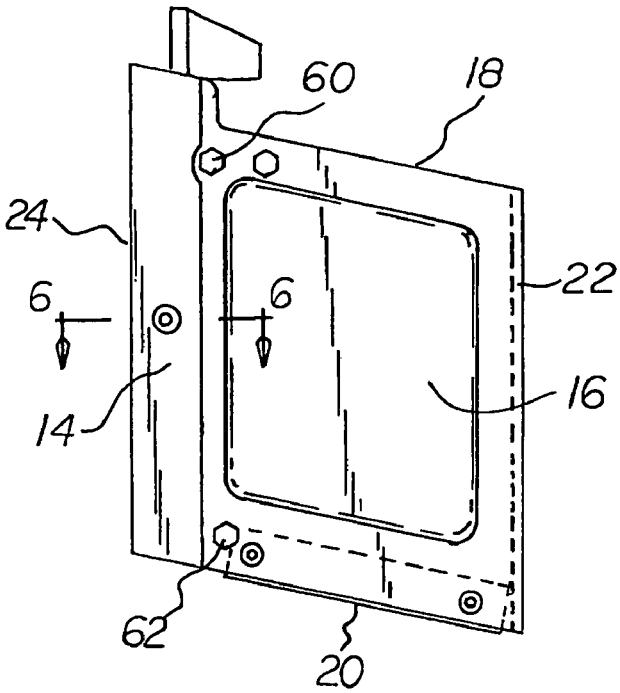
FIG 2
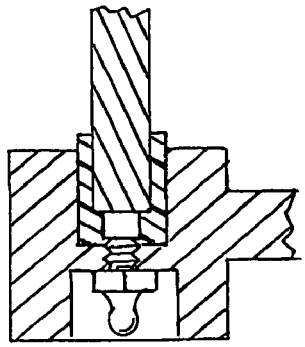
FIG 6

FIG 3
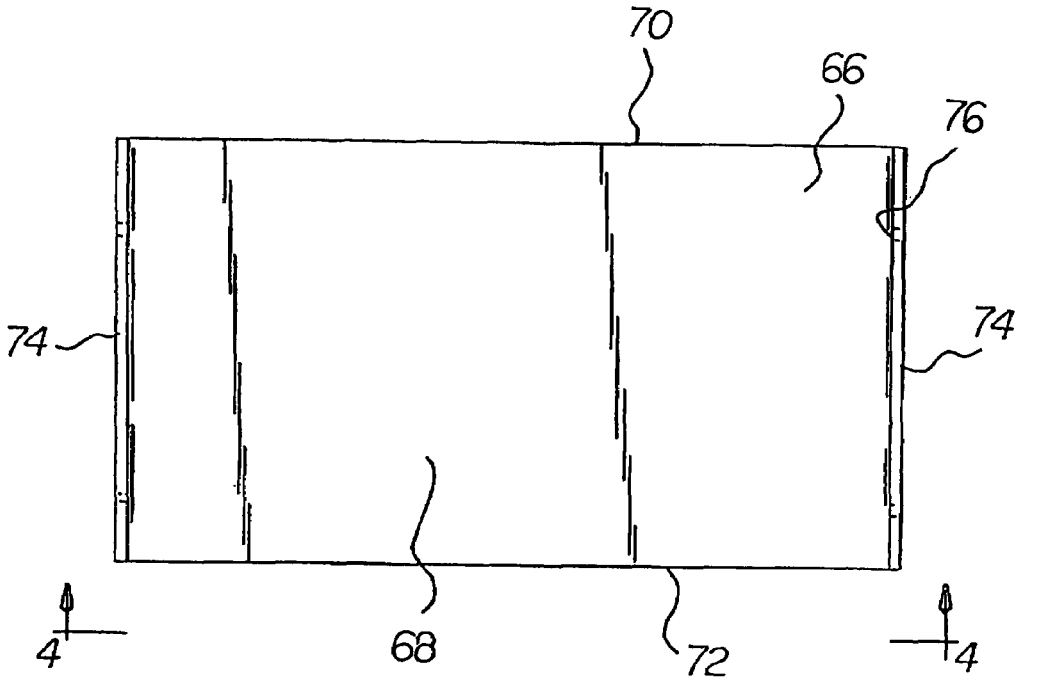
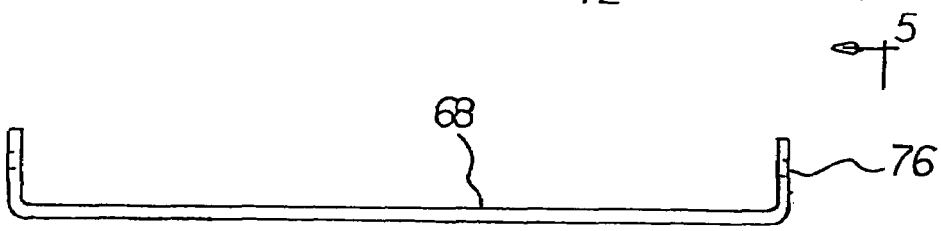
FIG 4
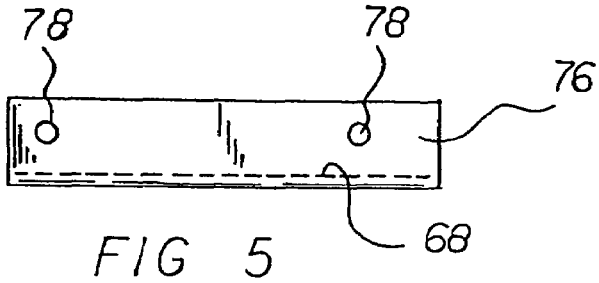
FIG 5

ANTI-SPLASH PAN SYSTEM

BACKGROUND OF THE INVENTION

1. Field of the Invention

The present invention relates to an anti-splash pan system and more particularly pertains to abating the inadvertent wetting of a height adjusting hydraulic cylinder in a safe, convenient and economical manner.

2. Description of the Prior Art

The use of steering systems of known designs and configurations is known in the prior art. More specifically, steering systems of known designs and configurations previously devised and utilized for the purpose of steering through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,997,370 issued Dec. 7, 1999 to Fetchko relates to an Outboard Hydraulic Steering Assembly with Reduced Support Bracket Rotation. U.S. Pat. No. 5,782,662 issued Jul. 21, 1998 to Icenogle relates to a Hydraulic Marine Jack Plate. U.S. Pat. No. 5,052,320 issued Oct. 1, 1991 to Cremer relates to an Emergency Tiller for Outboard Motors. U.S. Pat. No. 4,559,889 issued Dec. 24, 1985 to Olson relates to an Outboard Motor Steering Control System. Lastly, U.S. Pat. No. 4,227,480 issued Oct. 14, 1980 to Carras relates to a Motor Mount Bracket for Twin-Hull Sail Boats.

While these devices fulfill their respective, particular objectives and requirements, the aforementioned patents do not describe an anti-splash pan system that allows for abating the inadvertent wetting of a height adjusting hydraulic cylinder in a safe, convenient and economical manner.

In this respect, the anti-splash pan system according to the present invention substantially departs from the conventional concepts and designs of the prior art, and in doing so provides an apparatus primarily developed for the purpose of abating the inadvertent wetting of a height adjusting hydraulic cylinder in a safe, convenient and economical manner.

Therefore, it can be appreciated that there exists a continuing need for a new and improved anti-splash pan system which can be used for abating the inadvertent wetting of a height adjusting hydraulic cylinder in a safe, convenient and economical manner. In this regard, the present invention substantially fulfills this need.

SUMMARY OF THE INVENTION

In view of the foregoing disadvantages inherent in the known types of steering systems of known designs and configurations now present in the prior art, the present invention provides an improved anti-splash pan system. As such, the general purpose of the present invention, which will be described subsequently in greater detail, is to provide a new and improved anti-splash pan system and method which has all the advantages of the prior art and none of the disadvantages.

To attain this, the present invention essentially comprises an anti-splash pan system. First provided is a generally rectilinear housing. The housing is positionable on the transom of a boat. The housing has similarly configured vertically disposed side plates. The side plates are in a trapezoidal configuration. The housing has parallel upper and lower edges. The housing has parallel front and rear edges. The housing has an upper transom bar. The upper transom bar couples the side plates adjacent to the upper edges. The housing has a lower transom bar. The lower transom bar couples the side plates adjacent to the lower and rear edges. The housing has short front plates. The front plates extend inwardly from the front edges. An enlarged space is provided between the front plates. The front plates are in a common plane. The housing has apertures. The apertures couple the housing to a transom of a boat. The housing has parallel slots. The parallel slots are formed in the side plates adjacent to the rear edge. The slots face each other in a generally vertical orientation. The housing is fabricated of a carbon steel.

Provided next is a jack plate. The jack plate is in a rectangular configuration. The jack plate has parallel upper and lower edges. The jack plate has parallel side edges. The side edges are provided between the upper and lower edges. The jack plate has apertures. The apertures couple a motor to the jack plate. The side edges of the jack plate are slidably received by the slots of the side plate. In this manner essentially vertical movement of the jack plate with respect to the housing is provided. The jack plate is fabricated of carbon steel.

Further provided is a hydraulic cylinder. The hydraulic cylinder has a lower end. The lower end is coupled to the lower transom. The hydraulic cylinder has an upper end. The hydraulic cylinder has a piston rod. The piston rod is coupled to the jack plate. The hydraulic cylinder has a clevis and bolt. The clevis and the bolt are provided between the piston rod and the jack plate. The hydraulic cylinder is adapted to raise and lower the jack plate and a motor thereon with respect to the housing and a boat. The housing is coupled to a boat. The hydraulic cylinder has a rigid upper stiffening rod. The rigid stiffening rod is provided between the side plates rearwardly of the upper transom bar. The hydraulic cylinder has a rigid lower stiffening rod. The rigid lower stiffening rod is provided between the side plates in the slots adjacent to the lower edges of the side plates and rearwardly of the lower transom bar.

Provided last is an anti-splash pan. The anti-splash plan has a large central section. The large central section is provided in a rectangular configuration. The anti-splash pan has parallel front and rear edges. The anti-splash pan has parallel side edges. The parallel side edges are provided between the front and rear edges. The side edges have upturned sections. The side edges have a plurality of apertures. The apertures are provided in each side section. The side plates have apertures. The apertures are adjacent to their lower edges. The apertures are aligned with the apertures of the upturned sections. Bolts with nuts are provided. The bolts extend through the apertures of side and upturned sections. In this manner the anti-splash pan is secured to the housing. The side edges of the central section are in proximity to the side plates adjacent to the lower edges of the side plates. The anti-splash pan is fabricated of carbon steel. The rear end of the anti-splash pan is in proximity to the slots. The front end of the anti-splash pan is in proximity to the front plates. In this manner the pan will abate the splashing of water onto the hydraulic cylinder during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anti-splash pan system which has all of the advantages of the prior art steering systems of known designs and configurations and none of the disadvantages.

It is another object of the present invention to provide a new and improved anti-splash pan system which may be easily and efficiently manufactured and marketed.

It is further object of the present invention to provide a new and improved anti-splash pan system which is of durable and reliable constructions.

An even further object of the present invention is to provide a new and improved anti-splash pan system which is susceptible of a low cost of manufacture with regard to both materials and labor, and which accordingly is then susceptible of low prices of sale to the consuming public, thereby making such anti-splash pan system economically available to the buying public.

Even still another object of the present invention is to provide an anti-splash pan system for abating the inadvertent wetting of a height adjusting hydraulic cylinder in a safe, convenient and economical manner.

Lastly, it is an object of the present invention to provide a new and improved anti-splash pan system. A pan has a large central section in a rectangular configuration. The pan has parallel front and rear edges and parallel side edges. The side edges have upturned sections. The side edges have a plurality of apertures. The apertures couple the pan to side plates of a jack plate/hydraulic cylinder housing. The sides of the central section are in proximity to side plates adjacent to lower edges of side plates of a housing. The rear of the pan is in proximity to slots of a housing. The front of the pan is in proximity to front plates of a housing. In this manner the pan will abate the splashing of water onto a hydraulic cylinder during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an anti-splash pan system constructed in accordance with the principles of the present invention.

FIG. 2 is a side elevational view of the system taken along line 2-2 of FIG. 1.

FIG. 3 is a plan view of the anti-splash pan illustrated in the prior Figures.

FIG. 4 is a side elevational view of the anti-splash pan taken along line 4-4 of FIG. 3.

FIG. 5 is an end elevational view of the anti-splash pan taken along line 5-5 of FIG. 4.

FIG. 6 is a cross sectional view taken along line 6-6 of FIG. 2.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved anti-splash pan system embodying the principles and concepts of the present invention and generally designated by the reference numeral 10 will be described.

The present invention, the anti-splash pan system 10 is comprised of a pan.

First provided is a generally rectilinear housing 14. The housing is positionable on the transom of a boat. The housing has similarly configured vertically disposed side plates 16. The side plates are in a trapezoidal configuration. The housing has parallel upper and lower edges 18, 20. The housing has parallel front and rear edges 22, 24. The housing has an upper transom bar 26. The upper transom bar couples the side plates adjacent to the upper edges. The housing has a lower transom bar 28. The lower transom bar couples the side plates adjacent to the lower and rear edges. The housing has short front plates 30. The front plates extend inwardly from the front edges. An enlarged space is provided between the front plates. The front plates are in a common plane. The housing has apertures 32. The apertures couple the housing to a transom of a boat. The housing has parallel slots 34. The parallel slots are formed in the side plates adjacent to the rear edge. The slots face each other in a generally vertical orientation. The housing is fabricated of a carbon steel.

Provided next is a jack plate 38. The jack plate is in a rectangular configuration. The jack plate has parallel upper and lower edges 40, 42. The jack plate has parallel side edges 44. The side edges are provided between the upper and lower edges. The jack plate has apertures 46. The apertures couple a motor to the jack plate. The side edges of the jack plate are slidably received by the slots of the side plate. In this manner essentially vertical movement of the jack plate with respect to the housing is provided. The jack plate is fabricated of carbon steel.

Further provided is a hydraulic cylinder 50. The hydraulic cylinder has a lower end 52. The lower end is coupled to the lower transom. The hydraulic cylinder has an upper end. The hydraulic cylinder has a piston rod 54. The piston rod is coupled to the jack plate. The hydraulic cylinder has a clevis 56 and bolt 58. The clevis and the bolt are provided between the piston rod and the jack plate. The hydraulic cylinder is adapted to raise and lower the jack plate and a motor thereon with respect to the housing and a boat. The housing is coupled to a boat. The hydraulic cylinder has a rigid upper stiffening rod 60. The rigid stiffening rod is provided between the side plates rearwardly of the upper transom bar. The hydraulic cylinder has a rigid lower stiffening rod 62. The rigid lower stiffening rod is provided between the side plates in the slots adjacent to the lower edges of the side plates and rearwardly of the lower transom bar.

Provided last is an anti-splash pan 66. The anti-splash plan has a large central section 6B. The large central section is provided in a rectangular configuration. The anti-splash pan has parallel front and rear edges 70, 72. The anti-splash pan has parallel side edges 74. The parallel side edges are provided between the front and rear edges. The side edges have upturned sections 76. The splash pan is oriented so as to generally slightly angled from the perpendicular in relation to the front edge of the housing, as seen in FIGS. 1 and 2. The splash pan having a generally C-shaped configuration (see FIG. 4) and is contained adjacent the lower edges of the housing (see FIGS. 1 and 2). This orientation places the splash Plate generally parallel with the water's surface, effectively abating the upward splashing of water. The side edges have a plurality of apertures 78. The apertures are provided in each side section. The side plates have apertures 80. The apertures are adjacent to their lower edges. The apertures are aligned with the apertures of the upturned sections. Bolts 82 with nuts 84 are provided. The bolts extend through the apertures of side and upturned sections. In this manner the anti-splash pan is secured to the housing. The side edges of the central section are in proximity to the side plates adjacent to the lower edges of the side plates. The anti-splash pan is fabricated of carbon steel. The rear end of the anti-splash pan is in proximity to the slots. The front end of the anti-splash pan is in proximity to the front plates. In this manner the pan will abate the splashing of water onto the hydraulic cylinder during operation and use.

FIG. 6 is a cross sectional view taken along line 6-6 of FIG. 2. Such Figure illustrates one of the grease fittings. One grease filling is installed on each side of the jack plate. The grease fittings keep the bearing area along each lateral edge of the jack plate properly lubricated during operation and use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anti-splash pan system comprising:

a lack plate/hydraulic cylinder housing having a lower edge and an upper edge and a front edge and a rear edge and side plates;

a splash pan having a large central section in a rectangular configuration with parallel front and rear edges and with parallel side edges, the side edges having upturned sections with a plurality of apertures for coupling to side plates of the jack plate/hydraulic cylinder housing with the sides of the central section of the pan being in proximity to side plates adjacent to lower edges of side plates of a housing, the rear of the pan being in proximity to slots of the housing, the splash pan being oriented so as to generally slightly angled from the perpendicular in relation to the front edge of the housing, the splash pan being contained within the side plates of the housing and adjacent the lower edges of the housing thereby placing the splash plate generally parallel with the lower edge of the housing, effectively abating the upward splashing of water, the front of the splash pan being in proximity to front plates of the housing.

2. The system as set forth in claim 1 and further including a generally rectilinear housing positionable on the transom of a boat, the housing having similarly configured vertically disposed side plates in a trapezoidal configuration with parallel upper and lower edges and with parallel front and rear edges, the housing having an upper transom bar coupling the side plates adjacent to the upper edges and a lower transom bar coupling the side plates adjacent to the lower and rear edges, short front plates extending inwardly from the front edges with an enlarged space between the front plates, the front plates being in a common plane with apertures for coupling the housing to a transom of a boat, the housing having parallel slots formed in the side plates adjacent to the rear edge, the slots facing each other in a generally vertical orientation.

3. The system as set forth in claim 2 and further including a jack plate in a rectangular configuration with parallel upper and lower edges and with parallel side edges between the upper and lower edges, the jack plate having apertures for coupling a motor thereto, the side edges of the jack plate being slidably received by the slots of the side plate for essentially vertical movement of the jack plate with respect to the housing.

4. The system as set forth in claim 3 and further including a hydraulic cylinder having a lower end coupled to the lower transom and an upper end with a piston rod coupled to the jack plate with a clevis and bolt between the piston rod and the jack plate, the hydraulic cylinder adapted to raise and lower the jack plate and a motor thereon with respect to the housing and a boat to which the housing is coupled, the hydraulic cylinder having a rigid upper stiffening rod between the side plates rearwardly of the upper transom bar, the hydraulic cylinder having a rigid lower stiffening rod between the side plates in the slots adjacent to the lower edges of the side plates and rearwardly of the lower transom bar.

5. The system as set forth in claim 4 and further including grease fittings associated with the jack plate.

6. An anti-splash pan system for abating the inadvertent wetting of a height adjusting hydraulic cylinder in a safe, convenient and economical manner comprising, in combination:

a generally rectilinear housing positionable on the transom of a boat, the housing having similarly configured vertically disposed side plates in a trapezoidal configuration with parallel upper and lower edges and with parallel front and rear edges, the housing having an upper transom bar coupling the side plates adjacent to the upper edges and a lower transom bar coupling the side plates adjacent to the lower and rear edges, short front plates extending inwardly from the front edges with an enlarged space between the front plates, the front plates being in a common plane with apertures for coupling the housing to a transom of a boat, the housing having parallel slots formed in the side plates adjacent to the rear edge, the slots facing each other in a generally vertical orientation, the housing being fabricated of a carbon steel;

a jack plate in a rectangular configuration with parallel upper and lower edges and with parallel side edges between the upper and lower edges, the jack plate having apertures for coupling a motor thereto, the side edges of the jack plate being slidably received by the slots of the side plate for essentially vertical movement of the jack plate with respect to the housing, the jack plate being fabricated of carbon steel;

a hydraulic cylinder having a lower end coupled to the lower transom and an upper end with a piston rod coupled to the jack plate with a clevis and bolt between the piston rod and the jack plate, the hydraulic cylinder adapted to raise and lower the jack plate and a motor thereon with respect to the housing and a boat to which the housing is coupled, the hydraulic cylinder having a rigid upper stiffening rod between the side plates rearwardly of the upper transom bar, the hydraulic cylinder having a rigid lower stiffening rod between the side plates in the slots adjacent to the lower edges of the side plates and rearwardly of the lower transom bar; and an anti-splash pan having a large central section in a rectangular configuration with parallel front and rear edges, and with parallel side edges between the front and rear edges, the side edges having upturned sections with a plurality of apertures through each side section, the side plates having apertures adjacent to their lower edges aligned with the apertures of the upturned sections and with bolts with nuts extending through the apertures of side and upturned sections for securing the anti-splash pan to the housing with the side edges of the central section in proximity to the side plates adjacent to the lower edges of the side plates, the anti-splash pan being fabricated of carbon steel, the rear end of the anti-splash pan being in proximity to the slots and the front end of the anti-splash pan being in proximity to the front plates whereby the pan will abate the splashing of water onto the hydraulic cylinder during operation and use.

* * * * *